US005668433A

United States Patent [19]

Everest et al.

[11] Patent Number: 5,668,433

[45] Date of Patent: *Sep. 16, 1997

[54] ELECTRODELESS FLUORESCENT LAMP HAVING AN INSULATIVE HOUSING ARRANGEMENT

[75] Inventors: Steven J. Everest, Leicester; Basil Antonis, London, both of United Kingdom

[73] Assignee: General Electric Company, Schenectady, N.Y.

[ * ] Notice: The term of this patent shall not extend beyond the expiration date of Pat. No. 5,412,280.

[21] Appl. No.: 356,092

[22] Filed: Dec. 15, 1994

[30] Foreign Application Priority Data

Dec. 22, 1993 [GB] United Kingdom ..... 9326123

[51] Int. Cl.[6] ..... H01J 1/52; H01J 1/62; H01J 17/16

[52] U.S. Cl. ..... 313/313; 313/489; 313/635; 315/85

[58] Field of Search ..... 313/313, 489, 313/635; 315/85, 248, 344, 58, 71

[56] References Cited

U.S. PATENT DOCUMENTS 5,239,238 8/1993 Bergervoet ..... 315/85
5,412,280 5/1995 Scott ..... 315/248

*Primary Examiner*—Sandra L. O'Shea
*Assistant Examiner*—John Ning
*Attorney, Agent, or Firm*—George E. Hawranko; Stanley C. Corwin

[57] ABSTRACT

An electrodeless fluorescent lamp comprises a sealed lamp vessel containing a fill capable of sustaining a discharge when suitably excited. The fill is excited by an RF electromagnetic field produced by a winding energized by an RF oscillator powered via a rectifier from the mains. To confine the RF field within the vessel a conductive coating FTO is provided inside the vessel. To at least reduce conducted interference a conductive coating A1 is provided on the outside of the vessel G. The coating A1 is electrically coupled (e.g., via 7) to RF ground which may be one side of the mains. An electrically insulative housing covers the coating A1. The housing which extends to a zone of maximum diameter of the vessel may grip the vessel.

13 Claims, 4 Drawing Sheets

ELECTRODELESS FLUORESCENT LAMP HAVING AN INSULATIVE HOUSING ARRANGEMENT

FIELD OF THE INVENTION

The present invention relates to an electrodeless fluorescent lamp. More particularly, this invention relates to such an electrodeless fluorescent lamp as includes an insulative housing arrangement which contributes to the EMI shielding capabilities of the lamp.

BACKGROUND OF THE INVENTION

An electrodeless fluorescent lamp is disclosed in U.S. Pat. No. 4,727,294 (U.S. Philips Corporation). The lamp of U.S. Pat. No. 4,727,294 comprises an externally spherical lamp vessel which is sealed and which contains a fill capable of sustaining a discharge when suitably excited. The discharge excites a phosphor coating on the inside of the vessel. The fill is excited by a core of magnetic material surrounded by a winding which is energized by a high frequency oscillator. The core and winding extend into a cylindrical sealing member of the vessel which extends into the spherical vessel. The lamp vessel is further provided with a light transparent, electrically conductive layer within the vessel to substantially confine the electric field generated by the core and winding within the vessel.

In order to reduce conducted interference, a portion of the external surface of the vessel is also provided with a conductive coating capacitively coupled to the conductive layer inside the vessel. The external coating is connected by a conductor to a power mains terminal of the lamp.

An electrically insulative, generally cylindrical, housing supports the spherical lamp vessel and the re-entrant sealing member. The housing has a diameter much smaller than the spherical lamp vessel. The housing contains the oscillator circuit and mechanically connects the lamp vessel to the lamp cap. The portion of the external surface of the vessel which is provided with the conductive coating is inside the housing.

Although U.S. Pat. No. 4,727,294 achieves an advance over the prior art in terms of reducing EMI characteristics of an electrodeless fluorescent lamp, there is still a need to further reduce EMI emissions so as to reach compliance with appropriate governmental standards relating to EMI emissions. Moreover, such patent further could be improved if the teaching contained therein could be extended to other lamp configurations rather than just the conventional A-line configuration. Accordingly, it would be advantageous if an electrodeless fluorescent lamp could be provided that would further improve EMI suppression properties as compared to known lamps of this type and further, could be applied to different lamp configurations such as a reflector lamp for instance.

SUMMARY OF THE INVENTION

According to one aspect of the present invention there is provided an electrodeless fluorescent lamp comprising a sealed lamp vessel containing at least a luminescent layer and a fill capable of sustaining a discharge when excited, the vessel being arranged to emit light at least from a first portion thereof, an electrically insulative housing which extends over a second portion of the vessel, and an external electrically conductive coating extending over the second portion and electrically isolated by the housing.

In an embodiment, the housing also houses energizing means for exciting the fill. The external coating is electrically coupled to an RF ground within the energizing means. The RF ground may be electrically coupled to a mains supply terminal of the lamp.

The lamp vessel may include a reflective layer which reflects light from the said second portion to the said first portion.

In one embodiment the housing grips, and thereby supports, the lamp vessel around the zone of maximum extent.

In another embodiment the lamp vessel is fixed to, and thereby supported by, a support of the energizing means.

BRIEF DESCRIPTION OF THE DRAWINGS

For a better understanding of the present invention reference will now be made, by way of example, to the accompanying drawings in which.

DETAILED DESCRIPTION OF THE INVENTION

Figure 1:
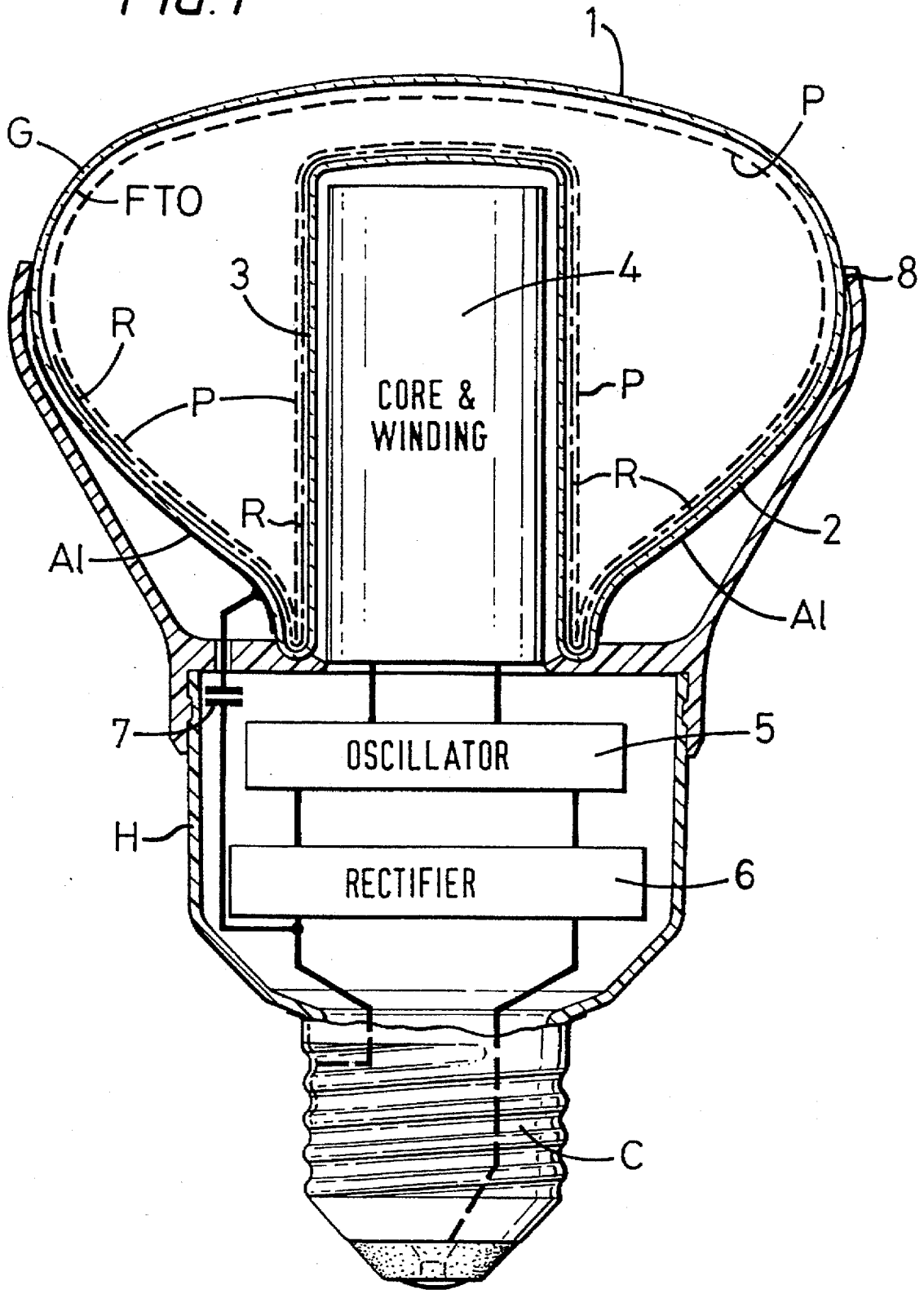
FIG. 1 is a schematic sectional illustration of one embodiment of an electrodeless fluorescent lamp in accordance with one aspect of the invention.

The illustrative fluorescent electrodeless lamp of FIG. 1 comprises a sealed glass lamp vessel G which is "mushroom" shaped having a face 1 which is a section of a sphere and a curved body 2 tapering away from the face 1. A re-entrant cylinder 3 also of glass is fused to the body 2. The vessel contains a fill (not shown), e.g., of mercury and a rare gas, which when excited, produces a discharge of ultraviolet (UV) light. On the internal surface of the vessel G and on the surface of the cylinder 3 is a layer of phosphor P which converts the UV light into visible light, as in a conventional fluorescent lamp.

The fill is excited by an electromagnetic field produced by a winding, comprising many turns of copper wire, arranged around a magnetic core of e.g., ferrite. The winding and core 4 are arranged in the re-entrant cylinder 3.

The winding is excited at high frequency, e.g., 2.65 MHz by an excitation circuit comprising an oscillator 5 powered from the power mains by a rectifier 6.

There are two potential modes of electromagnetic interference (EMI). One mode of EMI is the high frequency electromagnetic field produced by the winding. The other mode is conducted interference which comprises high frequency currents which may be capacitively coupled by stray capacitance to the mains.

In order to substantially confine the high frequency field to the lamp vessel, a light transparent, electrically conductive coating FTO which, as known in the field, is fluorinated tin oxide, is provided over the face 1 and body 2 of the lamp vessel, but not the cylinder 3. The coating has sufficient resistance, e.g., 300 ohms per square mm so that it does not present a short-circuit to the winding 4.

The coating FTO is preferably of fluorine-doped tin oxide but may be of other materials as known to be suitable in the art.

In order to eliminate conducted interference a conductive coating A1 is provided on the outside of the lamp vessel, capacitively coupled to the internal coating FTO. The external coating A1 may be aluminum or silver or any other suitable conductive coating. The coating A1 is electrically coupled to a radio frequency ground point in the excitation circuit. The radio frequency ground point may be one side of the power mains or on the RF side of RF filtering components within the excitation circuit. As shown in FIG. 1, the coating A1 is electrically connected via a capacitor 7 to one side of the power mains; the capacitor 7 is then a mains decoupling capacitor chosen to have low-impedance at the oscillator frequency, e.g., 2.65 MHz, and high impedance at mains frequency. Such capacitors are well known.

As will be apparent to those skilled in the art, the coating A1 may be directly connected to the RF ground point. In this case the RF ground point is preferably on the RF side of the RF filtering components. Such direct connection of the coating A1 to the RF side of the filtering components is currently preferred.

The external coating A1 covers the entire body 2 except for a strip 9 (shown in FIG. 2) of the body 2 which is left bare of coating so that the coating A1 does not form a continuous loop around the vessel. The coating A1 is spaced from the zone 8 of maximum diameter of the lamp vessel. The coating A1 does not extend over the face 1 nor over the re-entrant cylinder 3.

The capacitor 7 of FIG. 1 is connected to the coating A1 by a conductor which is fixed to the coating A1 by an electrically conductive adhesive, e.g., Silicone RTV available from GE Plastics, a division of the General Electric Company of New York, USA.

Within the lamp vessel 2, the conductive coating FTO is formed on the glass G of the vessel. A light reflective layer R is provided between the coating FTO and the phosphor P. The reflective layer R is preferably of titanium dioxide although other suitable light reflective materials could be used. The reflective layer R covers the body 2, but not the face 1, being spaced from the zone 8 of maximum diameter. The reflective layer R covers also the cylinder 3. The reflective layer R reflects light produced by the phosphor layer P forward to the face 1.

An electrically insulative plastics housing H is provided to:

(a) electrically isolate, and support the lamp vessel G, the circuits 5 and 6, the capacitor 7 and the cap C of the lamp;

(b) to electrically isolate the external conductive coating A1 and to mechanically protect the coating A1; and (c) grip the lamp vessel and adapt to variations in the maximum diameter of the lamp vessel G which occur in production.

In addition the housing must withstand the heat generated by the lamp.

Figure 2:
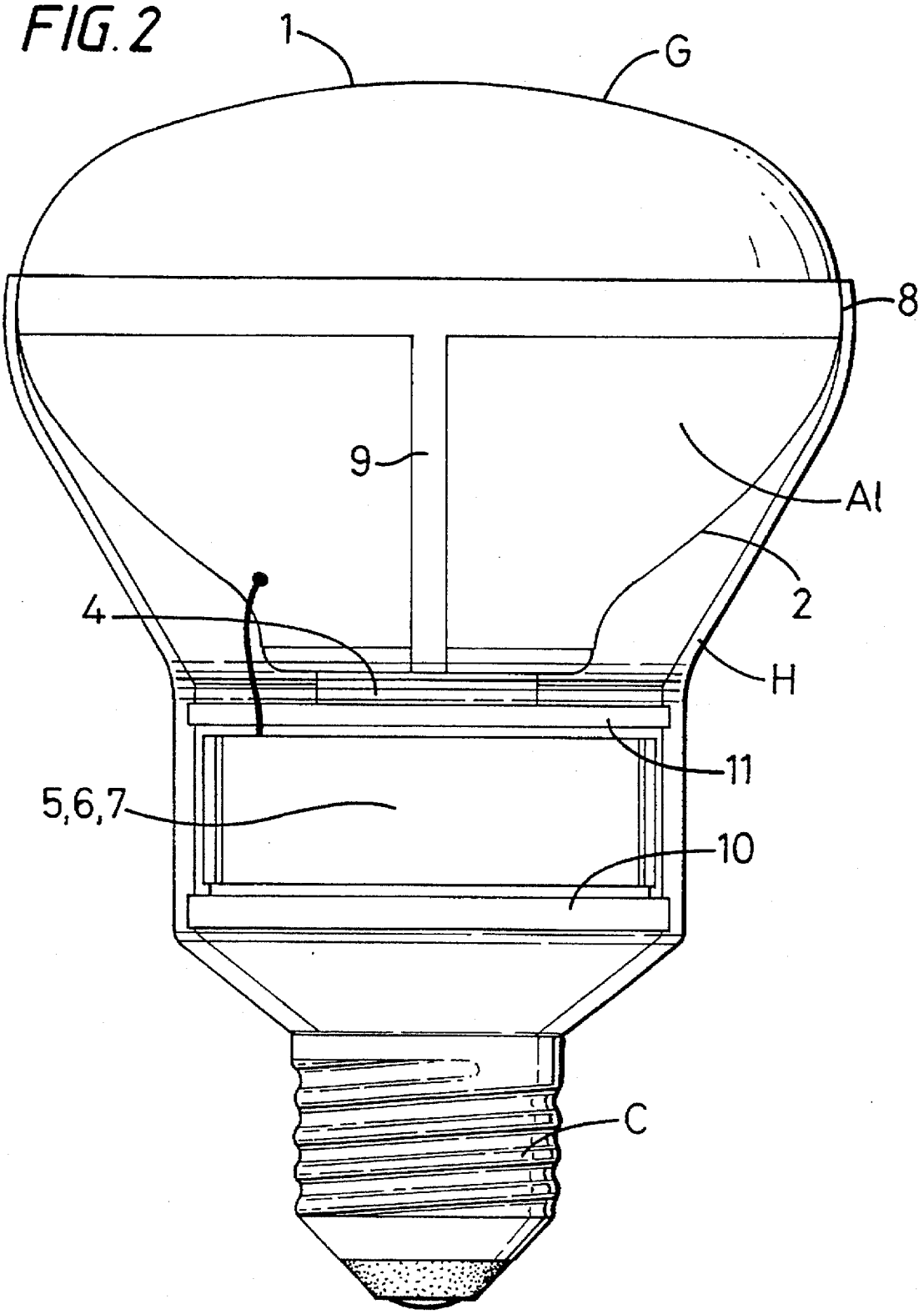
FIG. 2 is a side view of another embodiment of a lamp in accordance with the said one aspect of the invention.

Reference will now be made to FIG. 2.

The housing H is preferably opaque but could be transparent. For purposes of illustration only, FIG. 2 shows the lamp as it would appear if the housing were transparent.

The housing is fixed inside the lamp cap C by any suitable means. The cap being of metal, and the housing of plastic, the cap may be staked to the housing.

Within the housing H, above the cap C, circuit boards such as indicated at 10 provide the circuitry of the rectifier 6, oscillator 5 and the capacitor 7. The boards are supported by grooves in the housing. A barrier and support 11 supported by grooves in the housing further supports the core and winding 4.

The housing H extends over the body 2 of the lamp vessel covering the external coating A1 and, in this embodiment of the invention, engages the lamp vessel around the zone 8 of maximum diameter.

The maximum diameter of the glass vessel G varies by as much as +0.8 mm. In this embodiment of the invention, the housing must hold the glass vessel firmly and safely in position over the whole range of variation in diameter.

Figure 3:
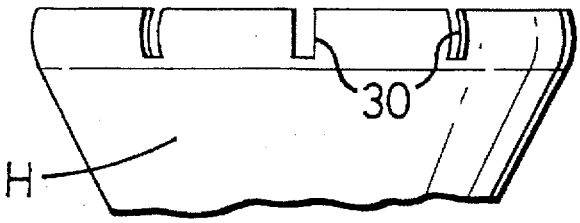
FIGS. 3 to 6 show alternative embodiments of a housing of the lamp of FIG. 1 or 2.

The housing H may be of one piece, which is of material flexible to accommodate the variations. Either the housing is made of sufficiently flexible material (as shown in FIG. 2) or fingers separated by slits 30 may be formed in the housing to provide the required flexibility as shown in FIG. 3.

Suitable materials are a polycarbonate such as LEXAN® produced by GE Plastics, a division of the General Electric Company of New York State, U.S.A., or glass-reinforced polyester.

Figure 4:
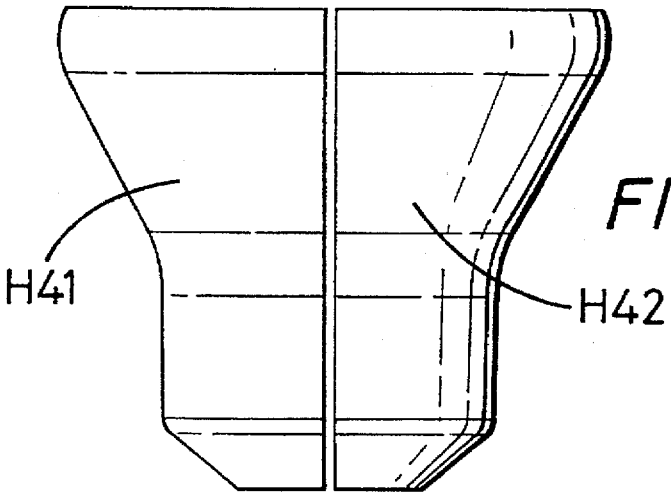

Alternatively, as shown in FIG. 4, the housing may be formed in two halves H41 and H42 which are joined axially of the lamp around the lamp components. The halves may be fixed together by any suitable means examples including ratchets, pegs, adhesive, and fusion of the two halves. Suitable materials for such a housing are LEXAN or glass-reinforced polyester.

Figure 5:
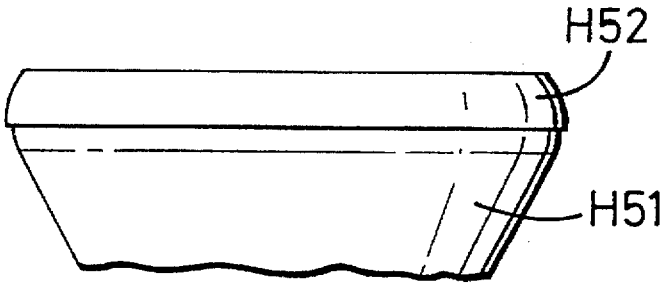

In another alternative, as shown in FIG. 5, the housing is formed in two parts. A first part H51 extends in one piece, from the cap towards the zone 8 of maximum diameter like the housing of FIG. 2 but unlike the housing of FIG. 2 does not extend beyond that zone. A second part is a ring H52 which extends over the zone 8 of maximum diameter and fixed to the first part H51 to grip the lamp vessel G. Suitable materials are LEXAN or glass-reinforced polyester.

Figure 6:
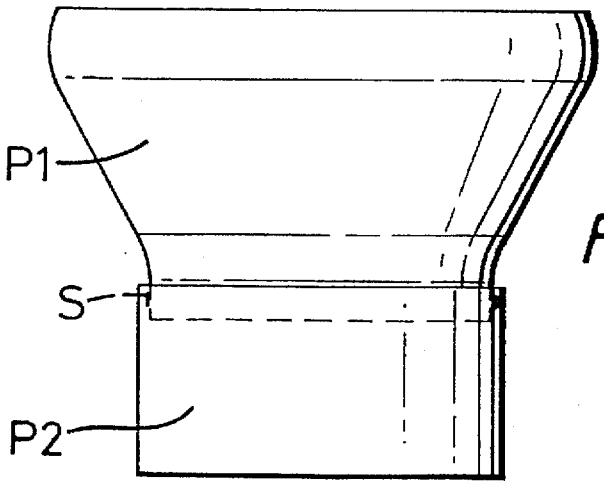

Another alternative shown in FIG. 6 comprises two parts, the first (P1) covering the evacuated envelope and the second (P2) covering the electronics. The two parts are fixed together (S) by any suitable means, e.g., a snap-fit arrangement. Suitable materials are LEXAN or glass-reinforced polyester.

Figure 7:
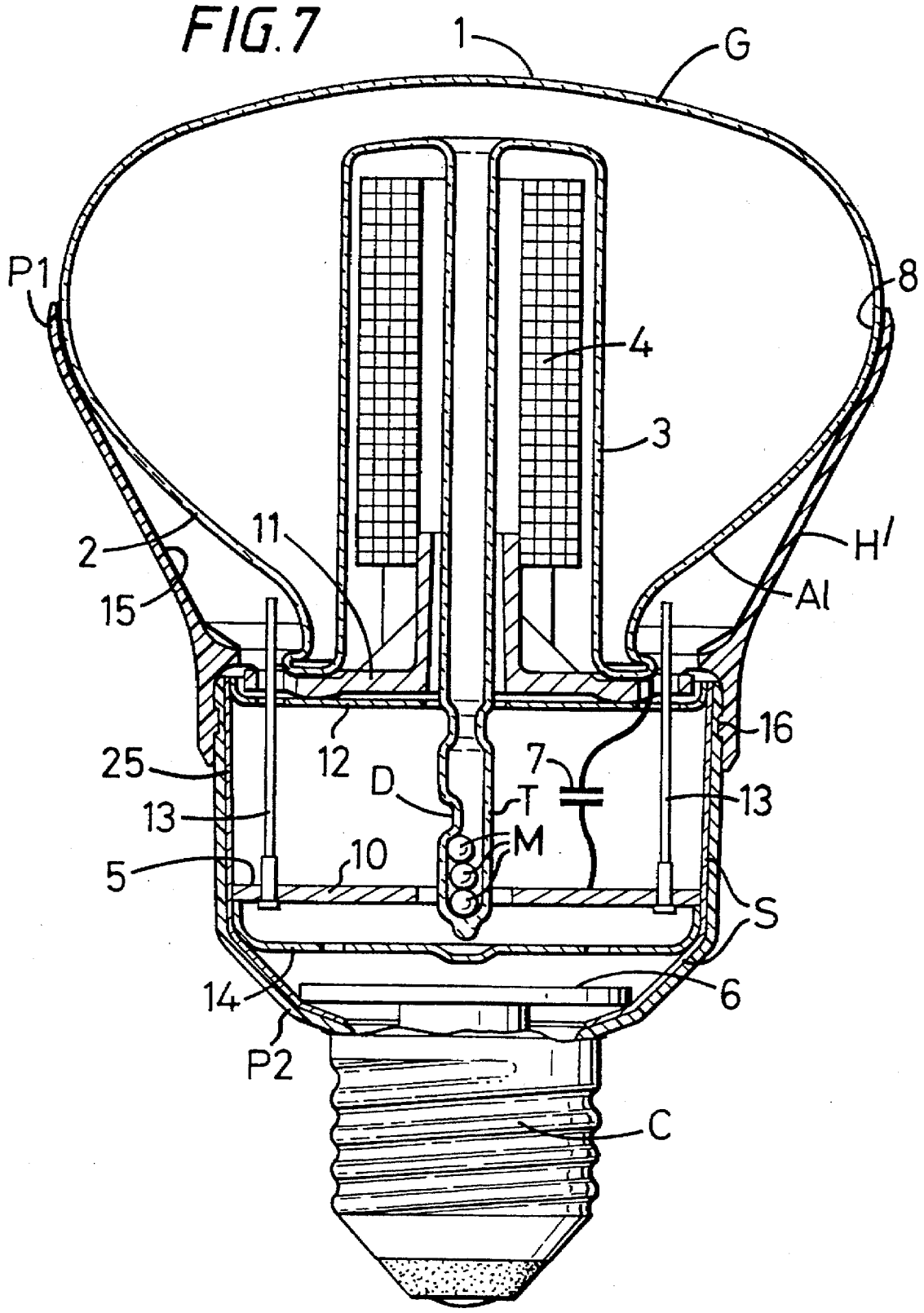
FIG. 7 is a schematic sectional illustration of an electrodeless fluorescent lamp in accordance with another aspect of the invention.

FIG. 7 shows an embodiment of the invention in accordance with another aspect of the invention. In FIG. 7 reference Indicia similar to those used in the other figures refer to elements similar to those shown in, and described with reference to the other figures.

The sealed glass lamp vessel G of FIG. 7 is generally of the same shape as the vessels G of FIGS. 1 to 6, and has the same layers FTO, R, P on the inside thereof and the same layer A1 on the outside thereof; (the layers are not indicated in FIG. 7). Unlike FIGS. 1 to 6, FIG. 7 shows tubulation T which extends axially of the lamp through the winding and core 4 towards the cap C. The tubulation houses mercury amalgam M, held in place by a dimple D in the tubulation.

The energizing circuitry 5, 6, 7 is housed within the housing H', inside an electrical screen S. The screen S comprises a closed metal box having cylindrical side wall 10 conforming in shape to the shape of the housing H' and lower and upper end walls 14 and 12. The side wall 5 extends beyond the lower wall 14 towards the cap C and supports the rectifier circuit board 6.

The oscillator circuit 5 on board 10 is supported within the closed box 14, 12, 5. The decoupling capacitor 7 may also be in the box.

Electrodes 13 extend upward from the board 10 and provide electrical connection to the winding 4.

The support 11 of the winding 4 and ferrite core is supported by the top wall 12 of the metal box.

Unlike the embodiments of FIGS. 1 to 6, the lamp vessel G is fixed to the support 11 by electrical conductive adhesive such as Silicone RTV. The electrically conductive adhesive provides electrical connection between the external conductive coating AL and the decoupling capacitor 7.

As with the lamp of FIG. 1, the decoupling capacitor 7 may be replaced by a direct connection to the RF ground point.

The housing H' functions to:

(a) electrically isolate and support the circuits 5 and 6, the capacitor 7 and the cap C;

(b) electrically isolate and mechanically protect the external conductive coating AL; and (c) adapt to variations in the maximum diameter of the vessel G.

The housing H' of FIG. 7 does not function to grip the vessel G. In addition the housing H' of FIG. 7 supports a truncated hollow cone 15 of electrical conductor, e.g., aluminum, which is electrically insulated from the external coating A1. The cone 15 forms a single continuous electrical turn around the lamp vessel.

The housing H' of FIG. 7 comprises two portions P1 and P2. Portion P2 supports the cap C and houses the energizing circuitry 5, 6, 7 and the electrical screening box S. The portion P1 surrounds the lamp vessel G, electrically isolates the external coating H, and supports the cone 15. The portions P1 and P2 are connected by a snap-fit arrangement 16 but may be connected by any suitable connecting means.

We claim:

1. An electrodeless fluorescent lamp comprising:

a sealed lamp vessel containing a luminescent layer, a fill capable of sustaining a discharge when suitably excited, and a coating of electrically conductive light transmissive material on the internal surface of the vessel;

electrical energizing means for exciting the fill;

a first electrically insulative housing portion from which the lamp vessel extends and which houses part of the electrical energizing means;

a second electrically insulative housing portion extending from the lamp vessel and housing a portion of the lamp vessel;

a coating of electrically conductive material on the external surface of the portion of the lamp vessel housed by the second housing portion, the external coating being electrically isolated by the second housing portion and being capacitively coupled to the internal coating;

means coupling the external coating to an electrical ground point to reduce conducted interference; and, wherein the vessel has a zone of maximum diameter and is arranged to emit light from at least a first portion of the vessel bounded by the said zone, the housing extending over a second portion of the vessel bounded by the said zone and the external coating extending over substantially the whole second portion of the vessel and being electrically isolated by the housing.

2. A lamp according to claim 1 wherein:

the sealed lamp vessel has a cylindrical re-entrant portion;

the energizing means includes an electromagnetic winding which projects into the re-entrant portion of the lamp vessel, for exciting the discharge.

3. A lamp according to claim 2 further comprising:

a lamp cap; and wherein the electrically insulative housing is fixed to the cap.

4. A lamp according to claim 1 wherein the vessel is supported by and fixed to a support of the electrical energizing means.

5. A lamp according to claim 1 wherein the housing grips the vessel around the zone of maximum diameter.

6. A lamp according to claim 5 wherein the housing comprises two halves joined axially of the lamp.

7. A lamp according to claim 5, wherein the housing comprises flexible fingers separated by slits in the said zone of maximum diameter.

8. A lamp according to claim 5 wherein the housing comprises a first part to which the cap is fixed and which houses the energizing means, and a second part which extends to the said zone of maximum diameter, and is fixed to the first part.

9. A lamp according to claim 1 wherein the lamp vessel includes a light reflective layer extending substantially from the said zone towards the lamp cap.

10. A lamp according to claim 9 wherein the light reflective layer reflects light from said second portion to said first portion of the vessel.

11. A lamp according to claim 1 wherein the housing is of polycarbonate or glass-reinforced polyester.

12. A lamp according to claim 1 wherein the external conductive coating is electrically coupled to a radio frequency ground of the energizing means.

13. A lamp according to claim 12 wherein the radio frequency ground is electrically coupled to a mains supply terminal of the lamp.

* * * * *